US006076819A

United States Patent [19]

Koike et al.

[11] Patent Number: 6,076,819

[45] **Date of Patent: *Jun. 20, 2000**

[54] SHEET FEEDING APPARATUS, AND IMAGE READING APPARATUS AND IMAGE FORMING APPARATUS PROVIDED THEREWITH

[75] Inventors: Michiro Koike; Noriyoshi Ueda, both of Kashiwa, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/999,142

[22] Filed: Dec. 29, 1997

[30] Foreign Application Priority Data

Dec. 28, 1996 [JP] Japan ..... 8-358668
May 29, 1997 [JP] Japan ..... 9-140691

[51] Int. Cl.[7] ..... B65H 5/00; B65H 3/44; B65H 3/14; B65H 7/02

[52] U.S. Cl. ..... 271/3.07; 271/9.12; 271/98; 271/108; 271/111; 271/119; 271/265.04

[58] Field of Search ..... 271/3.07, 9.01, 271/9.12, 10.11, 12, 98, 108, 111, 119, 265.04; 399/370

[56] References Cited

U.S. PATENT DOCUMENTS 5,069,436 12/1991 Lubberts ..... 271/3.1
5,557,387 9/1996 Hatano ..... 355/112 X
5,836,582 11/1998 Ogawa et al. ..... 271/12

FOREIGN PATENT DOCUMENTS 0 548 698 6/1993 European Pat. Off. .
0 612 000 8/1994 European Pat. Off. .
0 649 067 4/1995 European Pat. Off. .

*Primary Examiner*—Christopher P. Ellis
*Assistant Examiner*—Kenneth W Bower
*Attorney, Agent, or Firm*—Fitzpatrick, Cella, Harper & Scinto

[57] ABSTRACT

The present invention is provided as a sheet feeding apparatus comprising a friction separating/feeding means for separating and feeding a sheet by making use of frictional force, an air separating/feeding means for separating and feeding a sheet by making use of air and a selecting means for selecting either one of the friction separating/feeding means and the air separating/feeding means and for making the selected means separate and feed the sheet.

18 Claims, 7 Drawing Sheets

SHEET FEEDING APPARATUS, AND IMAGE READING APPARATUS AND IMAGE FORMING APPARATUS PROVIDED THEREWITH

BACKGROUND OF THE INVENTION

1. Field of the Invention

The present invention relates to a sheet feeding apparatus for feeding a sheet, and to image reading apparatus and image forming apparatus provided therewith.

2. Related Background Art

As automatic original feeding apparatus there are apparatus of an original circulating method (RDF) and a non-circulating method (ADF). In the former RDF case, there are apparatus for completing exposure while an original passes an exposure section, and discharging the original onto a region above (or below) an original mounting section; further, in the case of setting of plural sets of copies of originals, there are apparatus for obtaining plural sets of copies by successively recirculating the originals.

The combination of RDF with the flow reading mode for finishing exposure during a moving state of an original as described is free of the loss time corresponding to the moving time of exposure apparatus as against a fixed reading mode for first stopping the original and then moving the exposure apparatus along an original region. Therefore, the combination has advantages that it contributes to shortening of original changing time and, in turn, to speed increasing technology and productivity increasing technology of the copying system and that, when a comparison is made in a predetermined original changing time, it enables the original to be circulated at lower moving speed than in the fixed reading mode, thereby also contributing to quieting (noise reducing) technology.

First describing examples of the combination with RDF, there also exist systems able to achieve the speed increase and productivity increase of the copying system by combination with flash exposure technology. The detailed description of the flash exposure technology is omitted herein, but, when compared with the aforementioned exposure apparatus, it employs structure for completing exposure of all surfaces of an original at one time and needs to use a high-power light source and a belt type photosensitive member, thus increasing the size of apparatus, the cost, and electric power consumption. It is, therefore, the present status that applications of this technology are limited to some large-scale high-speed machines.

The latter ADF apparatus has such structure that an original is fixed at a predetermined position on a platen, exposure of copying section is repeated a necessary copy set number of times by translationally moving the exposure apparatus, the original is discharged onto a predetermined discharge tray after completion of exposure, and this operation is successively repeated to obtain plural sets of copies from a series of originals. The copying system is combined with a sorter provided on the output side thereof, which eliminates the need for repetitively circulating the originals many times. Therefore, this apparatus has an advantage of relatively small damage of original.

Under the above circumstances of existence of the conventional technology, a variety of proposals have been made in order to achieve the speed increase and quieting in recent years.

A first example of the apparatus devised is a sheet medium conveying apparatus wherein the originals on a sheet mounting table are fed by automatically selecting one of two feeding means provided at both ends of the sheet mounting table, depending upon the conditions including the size of original and a set mode, and an original is conveyed up to an image reading section of the copier body to be read there.

For example, an original-recirculatable system is arranged, as shown in FIG. 8, so that in the original fixed reading mode (for feeding the original through a first feeding means) a plurality of sheet originals P loaded on a sheet original mounting table 304 are separated one by one by first separating means 306, they are conveyed by feeding means 338 to be successively loaded at an arbitrary position on platen 303, an image of each original is read while moving an image reading section (optical system) 380 in the direction a in the copier body 301, and the original is reloaded on the sheet mounting table 304 by discharge means 311. In the original flow reading mode (for feeding the original through a second feeding means) the plurality of sheet originals P loaded on the original tray 304 are separated one by one by second separating means 314 to be conveyed by feeding means 315, the optical system 380 is fixed at a position the distance L apart from the home position (illustrated by a dashed line) of optical system 380, an image is read while the sheet original P is conveyed at constant speed on the platen 303 by a wide belt 307, and the original is loaded onto the sheet original mounting table 304 by the discharge means 311.

When the flow reading mode is selected, for example, under such conditions that a user puts originals of a small size (A4, B5, LTR, or the like) on the original tray 304, a start key (not illustrated) of the copier body is on, a first entrance sensor 322 is on, and a sheet medium length detecting sensor 368 is off, the operation advances in the flow reading mode. First, the original tray 304 falls down to a predetermined position about the fulcrum of 340, a stopper (sheet stack conveying means) 321 conveys the stack of sheet originals P toward the second separating means 314 to move the stack up to the position of stack conveying position detecting sensor 328 (before the stack conveying position detecting sensor 328 becomes on), feeding from the second feeding means 315 is started to feed the original to the platen 303, the image of the original is read in the aforementioned original flow reading mode, and then the sheet original is discharged from the discharge roller 311 onto the original tray 304. The stopper 321 pushes the rear end of sheet original toward the second separating section every discharge of original so as to enhance alignment. For one more circulation, after the all sheet originals are discharged, the stack is conveyed together to be again fed and to be again copied.

The above devised apparatus was suitable for the productivity increase, because it is the original recirculating method processing apparatus to achieve the high original changing speed in the flow reading mode, and also suitable for the quieting, as described above; however, it required circulation of originals of a setting number times for obtaining plural copies thereof. The apparatus thus had the structure requiring the advanced technologies for realizing the system that gave less damage on the originals, for example, by decreasing the stress on the originals upon passage through the separating means of the above apparatus, curling of original upon passage through the bent path, and so on, and that had high reliability by decreasing the probability of conveyance failure upon handling of original.

Particularly, in the above apparatus, the separating and feeding means of original P employs the bottom separating and feeding method of a conventional belt retard system comprised of a retard belt and a feeding roller, as shown in FIG. 8. This method is a method for aligning the originals at their leading edges and feeding them, and it thus has an advantage that even a stack of originals with different sizes mixed can be separated and fed. However, it has a problem of soiling of original occurring when a printed surface of the first original P rubs the back surface of the second original P upon feeding from the lowermost of the originals P mounted in the face-up state. Various means have been considered to overcome it, and considerable improvements have been achieved in the soiling.

When the originals P had poorly fixed images and the number of originals P was large, the above soiling was conspicuous when seen in a stack of many originals P after copy. A further improvement was thus demanded. A separating and feeding method using air is known as feeding means for solving the problem of soiling of original. The structure of this air feeding is free of not only the problem of soiling of original but also the problem of abrasion of the belt and rubber in the retard system, and it thus has advantages of excellent durability and reliability.

In the above structure of air feeding it is, however, necessary to prevent accompanied conveyance by making use of the weight of originals P by mounting the originals on the original mounting tray 2 inclined at an angle of rise in the sheet feeding direction toward the air separating means, and to align the originals P at the trailing edges thereof.

Therefore, the air feeding method has a problem that it is not ready for handling a stack of originals P of different sizes mixed, different from the aforementioned retard system.

Further, in the air feeding method, when the originals have holes at the leading edges thereof in the original feeding direction, the separation air directed toward the leading edges of originals leaks through the hole portions, so that the second and after originals become reluctant to float. The air feeding method thus has another problem that it is not suitable for the originals with holes at the leading edges in the original feeding direction.

SUMMARY OF THE INVENTION

An object of the present invention is to provide a novel sheet feeding apparatus by making use of the various advantages of the conventional feeding methods and compensating for their weak points.

A first embodiment of the present invention is provided as a sheet feeding apparatus comprising a friction separating/feeding means for separating and feeding a sheet by making use of frictional force, an air separating/feeding means for separating and feeding a sheet by making use of air and a selecting means for selecting either one of the friction separating/feeding means and the air separating/feeding means and for making the selected means separate and feed the sheet.

A second embodiment of the present invention is provided as a sheet feeding apparatus applied to an image reading apparatus for reading an image of a sheet existing in an image reading section, the sheet feeding apparatus comprising a friction separating/feeding means for separating and feeding a sheet by making use of frictional force, a first conveying means for guiding the sheet separated and fed by the friction separating/feeding means to the image reading section, an air separating/feeding means for separating and feeding a sheet by making use of air, a second conveying means for guiding the sheet separated and fed by the air separating/feeding means to the image reading section and a selecting means for selecting either one of the friction separating/feeding means and the air separating/feeding means and for making the selected means separate and feed the sheet.

The selecting means is preferred to select the air separating/feeding means in a normal mode.

A third embodiment of the present invention is provided as a sheet feeding apparatus applied to an image reading apparatus for reading an image of a sheet existing in an image reading section, the sheet feeding apparatus comprising a tray on which a sheet is to be loaded, a first separating means for separating a sheet loaded on the tray, the first separating means including feeding means and retard means and a second separating means for separating a sheet loaded on the tray, the second separating means including an air knife and vacuum suction conveying means.

A sheet feeding apparatus is preferred to comprise a switchback conveying means including a switchback conveying path, the switchback conveying means conveying the sheet separated by the first separating means through the switchback conveying path from one end of the image reading section into the image reading section and thereafter switching the sheet back to convey the sheet through the switchback conveying path out of the image reading section and a closed loop conveying means including a closed loop conveying path forming a closed loop, the closed loop conveying means conveying the sheet separated by the second separating means through the closed loop conveying path, thereby conveying the sheet from the other end of the image reading section into the image reading section, the closed loop conveying means conveying the sheet out of the image reading section from the side opposite to the side where the sheet was conveyed thereinto.

The switchback conveying means is preferred to temporarily stop the sheet on the image reading section while the image reading apparatus is reading an image, and the closed loop conveying means continues conveyance of the sheet conveyed into the image reading section even while the image reading apparatus is reading the image, and the closed loop conveying means carries the sheet out thereof from the side opposite to the side where the sheet was conveyed thereinto.

The first separating means is preferred to be means for separating an original loaded on the tray, the means being provided on one side of the tray, and the second separating means is preferred to be means for separating an original loaded on the tray, the means being provided on another side of the tray different from the one side of the tray where the first separating means is provided, and at least one of the switchback conveying means and the closed loop conveying means returns a conveyed original to the tray.

A sheet feeding apparatus is preferred to comprise a moving means for moving a stack of sheets mounted on the tray to a predetermined separation position on the tray and a control means for controlling the moving means and the separating means, and the second separating means is means for separating the lowermost sheet from the other sheets by blowing of air to a lower portion of a leading edge of the stack of sheets having been conveyed to the separation position, and the control means controls the second separating means to start the blowing of air from the second separating means, prior to arrival of the stack of sheets at the separation position.

A sheet feeding apparatus is preferred to comprise thickness detecting means for detecting a thickness of the stack of sheets mounted on the tray at that time, and the control means changes a blowing amount of air from the second separating means, according to a detection result of the thickness detecting means.

The moving means is preferred to comprise pushing means for pushing a trailing edge of the stack of sheets to move the stack of sheets, and a conveying belt set on a tray surface of the tray, and the conveying belt rotates in synchronism with the movement of the stack of sheets by the pushing means.

A fourth embodiment of the present invention is provided as a sheet reading apparatus comprising the sheet feeding apparatus and a reading means for reading a sheet having been fed thereto by the sheet feeding apparatus.

A fifth embodiment of the present invention is provided as an image forming apparatus comprising the sheet feeding apparatus, a reading means for reading an image of a sheet having been fed thereto by the sheet feeding apparatus and an image forming means for forming the image of the sheet having been read by the reading means, on a recording medium of a sheet shape.

A sixth embodiment of the present invention is provided as a sheet feeding apparatus comprising a sheet tray on which a stack of sheets are to be mounted, a moving means for moving a stack of sheets mounted on the sheet tray to a predetermined separation position on the sheet tray, a separating means for separating the lowermost sheet from the other sheets by blowing of air to a lower portion of a leading edge of the stack of sheets having been conveyed to the separation position and a control means for controlling the moving means and the separating means, and the control means to controls the separating means start the blowing of air, prior to arrival of the stack of sheets at the separation position.

A sheet feeding apparatus is preferred to comprise a thickness detecting means for detecting a thickness of the stack of sheets mounted on the tray at that time, and the control means is preferred to change a blowing amount of air from the separating means, according to a detection result of the thickness detecting means.

The moving means is preferred to comprise a pushing means for pushing a trailing edge of the stack of sheets to move the stack of sheets, and a conveying belt set on a tray surface of the tray, and the conveying belt rotates in synchronism with the movement of the stack of sheets by the pushing means.

A seventh embodiment of the present invention is provided as a sheet feeding apparatus comprising a sheet tray on which a sheet is to be mounted, a pushing means for pushing a trailing edge of a sheet mounted on the sheet tray to move the sheet to a predetermined separation position on the sheet tray, a conveying belt set in a tray surface of the sheet tray and a control means for controlling the pushing means and the conveying belt, and the control means controls the conveying belt to rotate in synchronism with the movement of the sheet by the pushing means.

An eighth embodiment of the present invention is provided as an image reading apparatus comprising an image reading means comprising a sheet table, the image reading means reading an image of a sheet placed on the sheet table and the sheet feeding apparatus as described in the fifth, sixth or seventh embodiment for successively conveying sheets to the sheet table.

As described above, the sheet feeding apparatus and image forming apparatus of the present invention can perform secure separation and feeding of originals.

DESCRIPTION OF THE PREFERRED EMBODIMENTS

The embodiments of the present invention will be described by reference to the drawings.

The present embodiment is characterized in that, in transferring an original mounted on the original tray to an air feedable position (an air separating position), blowing of separating air (at least preparation for blasting, for example, setting of an air quantity according to the thickness of original stack) is started prior to arrival of original at the air separating position. It is also characterized in that upon the conveyance the adsorption belt is rotated in synchronism with movement of the original stack.

Figure 1:
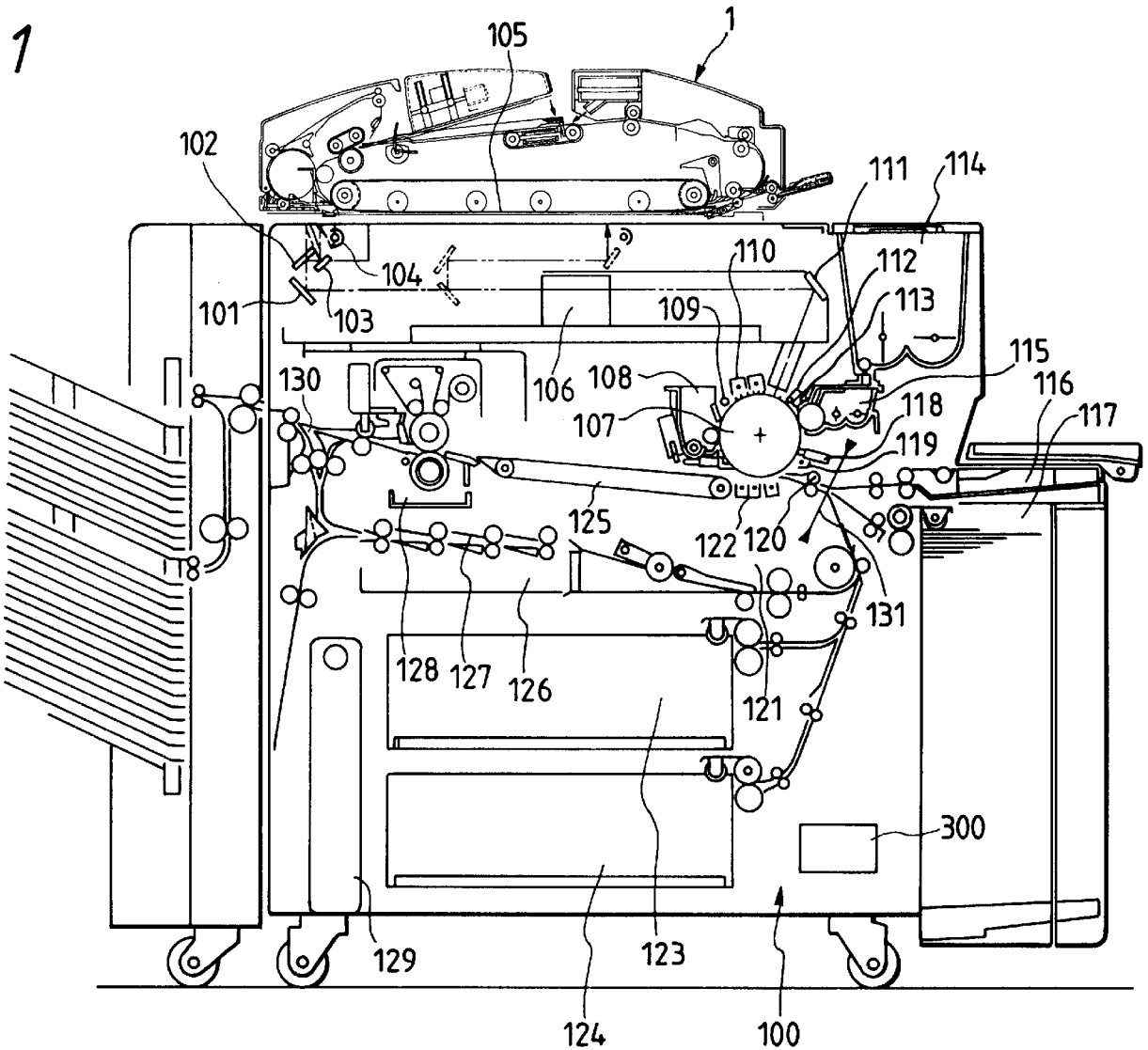
FIG. 1 is a drawing to show the schematic structure of an image forming apparatus as the first embodiment of the present invention.

First, the image forming apparatus 100 of the present embodiment will be schematically described referring to FIG. 1.

The automatic original feeding apparatus 1 conveys an original mounted on the original tray up to a predetermined read position. The automatic original feeding apparatus 1 will be described in detail hereinafter.

As well known, the optical system is composed of third mirror 101, second mirror 102, first mirror 103, original illuminating lamp 104, zoom lens 106, fourth mirror 111, and so on. The optical system transmits information of an original on platen 105 onto photosensitive drum 107.

The above optical system is constructed so as to be capable of both fixed reading and flow reading. Specifically, upon the fixed reading the original is fixed at a constant position and an exposure section translationally moves on the platen to read the image. On the other hand, upon the flow reading the exposure section is fixed at a predetermined position and the original is moved to read the image. The home position of the optical system in the fixed reading (original: fixed, optical system: moving) is at a first image head (fixed reading image head) position G (see FIG. 2). A second image head (flow reading image head) position H is the fixed position of the optical system in the flow reading. The second image head position H is located the distance L right from the first image head position G.

Next, the image thus read by the optical system is formed on a transfer medium separately prepared, by an image forming section. The image forming section is provided, as well known, with drum cleaner 108, pre-exposure lamp 109, primary charger 110, blank exposure lamp 112, potential sensor 113, hopper section 114 of toner, developing unit 115, multifeeder 116, side tray 117, roller electrode 118, transfer pre-charger 119, registration roller 120, refeeding section (for both-side copy) 121, transfer-separation charger 122, upper front tray 123, lower front tray 124, conveying section 125, intermediate tray 126, second conveying section 127, fixing unit 128, waste toner collecting vessel 129, sheet discharging section 130, copy-sheet-output-side device (sorter), and so on.

Each section of the image forming apparatus is generally controlled by control device 300.

As described previously, the present embodiment is mainly characterized by the automatic original feeding apparatus 1. Therefore, the following description is focused mainly on the automatic original feeding apparatus 1.

The structure of the automatic original feeding apparatus 1 of the present embodiment will be described referring to FIG. 2 and FIG. 3.

The automatic original feeding apparatus 1 has two original conveying paths (switchback path and closed loop path). The two conveying paths are used separately by selection, depending upon the set mode and the original size.

The switchback path is used in the case of the originals of a large size (for example, B4, A3, etc.) and in the case of originals of different sizes mixed. The conveying direction in the switchback path is indicated by arrow A in the drawing. In feeding through the switchback path, an original of original stack P mounted on the original tray 2 is guided through a path PH1 and then is positioned at the predetermined position on the platen 105 of image forming apparatus 100, and the exposure operation is carried out thereat by the optical system. After completion of the exposure operation, the original is returned in the direction C (through a discharge path PH2) again onto the original tray 2.

On the other hand, the closed loop path is used in a one-side copy mode of originals of a small size. In the drawing the conveying direction in the closed loop path is indicated by arrow B. An original P on the original tray 2 is guided through a predetermined path PH3 and is positioned at the predetermined position on the platen 105 of the image forming apparatus 100. After completion of the exposure operation, the original is returned in the direction C (through the discharge path PH2) again onto the original tray 2.

In each of the two conveying paths there are various sensors, rollers, and so on installed. The structure of each conveying path will be described below. It is, however, noted that each portion does not always belong to only either one of the conveying paths, but there are also some portions used in common to the both conveying paths.

Switchback Path

The original tray 2 is one for mounting the originals thereon. It is the matter of course that the original tray 2 is also used upon conveyance through the closed loop path. The original tray 2 is constructed so as to be movable up and down by tray up/down motor 59. An original P mounted on the original tray 2 is fed to the right (through the closed loop path) or to the left (through the switchback path) on the drawing, depending upon the conveying path used at that time. The original tray 2 is moved up upon conveyance through the switchback path or down upon conveyance through the closed loop path. The original tray 2 is inclined at a predetermined angle left side down from the relation with separating/feeding means (retard belt 5', feeding roller 5", etc. in the switchback path; adsorption belt 7 and air separating device 426 in the closed loop path) described hereinafter.

Recycle levers 3 are separating members for separating the original group before copy from that after copy. The recycle levers 3 are provided in the original mounting section. The tips of the recycle levers 3 extend through slots provided in side regulating plate 4 to the original tray 2. The recycle levers 3 are provided at two positions in order to be ready for originals of various sizes. The recycle levers 3 are driven by recycle motor 58 mounted in the tray side regulating plate 4. The recycle levers 3 form parts of stack thickness detecting mechanism 200 described hereinafter.

Conveying roller 5, retard belt 5', and feeding roller 5" are members for separating and feeding the originals when the switchback path is used. These are driven by separating motor 52.

The conveying roller 6' is one for guiding the original to the platen 105.

Inverting flapper 15 is used for inverting the original upon discharge and upon both-side copy. The inverting flapper 15 is driven by inverting flapper solenoid 73.

Inverting roller 6 is driving means for registration and inversion of original upon conveyance through the switchback path and is driven by inverting motor 55. The present embodiment employs a DC motor as the inverting motor 55 and it is controlled by PLL control to enable constant speed control between conveying belt 40 and inverting roller 6. Attached to the shaft of inverting motor 55 are a clock disk 56 and a clock detecting sensor 57 for permitting the PLL control. It can also be contemplated that a stepping motor is adopted as the inverting motor 55 and is controlled in synchronism with the separating motor 52 (for constant speed control).

Conveying/discharging roller 16 is used for guiding the original discharged from the platen 105 again to the platen 105 (or the tray 2). The conveying/discharging roller 16 is driven by discharge motor 61. The discharge motor 61 is also equipped with a clock disk 62 and a clock sensor 63 for enabling speed control upon transfer of original from the inverting roller 6 and upon discharge of original.

The conveying belt 40 is used for conveying the original on the platen 105. The conveying belt 40 is driven by stepping motor 51. The stepping motor is used because of its high controllability, i.e., good control response of start or stop. In addition, the present embodiment necessitates the constant speed operation at high accuracy between the conveying belt 40 (a backup roller driven by the conveying belt) and the registration roller 11, which is also one of reasons for the use of stepping motor.

The region of the switchback path where the inverting roller 6 and conveying/discharging roller 16 are set is shared with the closed loop path. Namely, the inverting roller 6 and conveying/discharging roller 16 are also used upon feeding of original through the closed loop path. The conveying belt 40 is also shared with the closed loop path.

Various sensors (empty sensor 30, separation sensor 31, switchback registration sensor 32, inversion sensor 33, and discharge sensor 39) for monitoring the conveying status of original are installed at respective positions of the switchback path. The empty sensor 30 is used for detecting that the original is set on the tray 2. The separation sensor 31 is used for detecting that the original is separated. The switchback registration sensor 32 is used for taking timings of registration of the original and correction of oblique feed. The inversion sensor 33 is used for detecting that the original is moved back in the switchback from the platen. The discharge sensor 39 is used for detecting discharge of sheet.

Closed Loop Path

The adsorption belt 7 is one for adhering to the original and conveying it. This adsorption belt 7 is set in a notch portion 404 provided in the center of the front part of original tray 2 (see FIG. 4 and FIG. 5). The adsorption belt 7 is perforated so as to have many holes 406. A suction duct 20 connected to a suction blower (not illustrated) is set on the back side (inside the track) of the adsorption belt 7. When the suction blower is actuated, the air is sucked from the holes 406 of suction belt 7 through the suction duct 20. This suction causes the lowermost original out of the originals mounted on the original tray 2 to be adhered to the adsorption belt 7. When the suction belt 7 is rotated in that state, the original thus adhered can be conveyed. The suction duct 20 is provided with air valve 21 for controlling on/off of suction (see FIG. 3). The air valve 21 is constructed to be opened or closed by solenoid 22.

Figure 4:
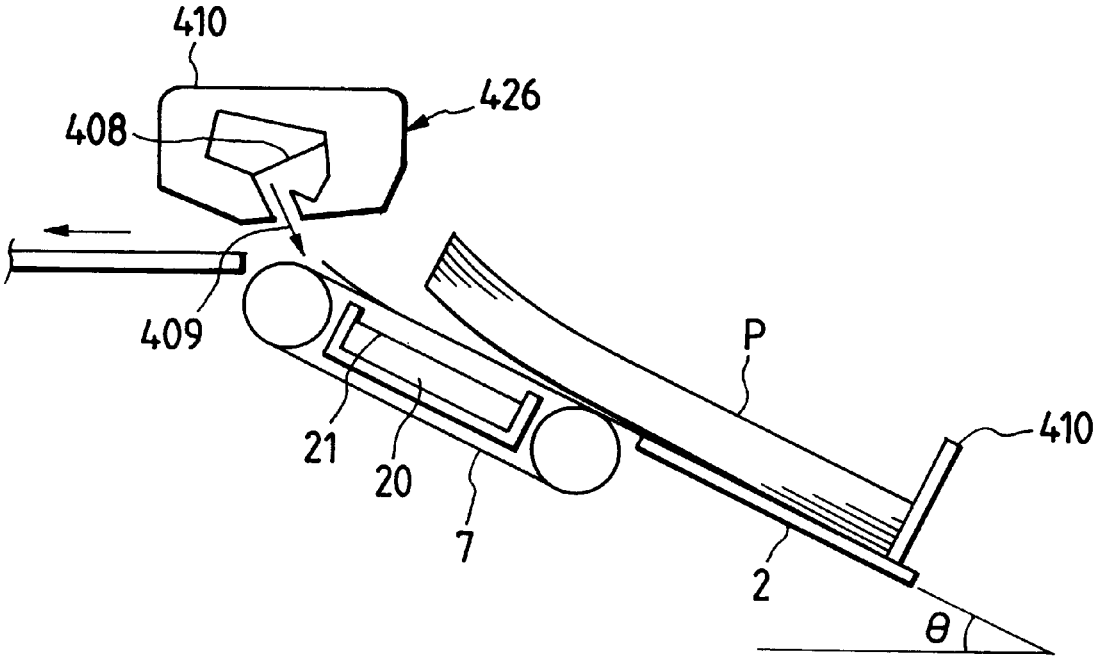
FIG. 4 is a drawing to show the details of an air separating-feeding mechanism.
Figure 5:
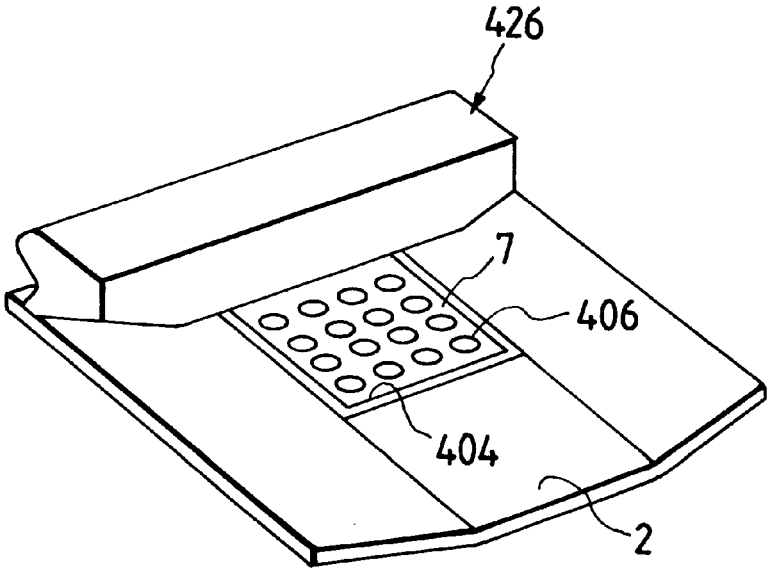
FIG. 5 is a drawing to show the details of the air separating-feeding mechanism.

An air separating device 426 is provided for blowing air obliquely from above to the lower part of the original stack placed at the predetermined air separating position of the original tray 2, thereby certainly separating the lowermost original (see FIG. 4 and FIG. 5). The blowing of air is effected by blowing off the air supplied from a blower (not illustrated) through blowoff port 409 provided in the lower part of separating air duct 410. An air valve 408 for changing the air quantity according to the thickness of the original stack is provided in the separating air duct 410. The air valve 408 is constructed to be drive-controlled by stepping motor 9 so that the valve travel can be adjusted thereby.

Shutter 41 (see FIG. 2 and FIG. 3) is provided for pushing the trailing edges of the originals (the left edges on the drawing) mounted on the original tray 2 to convey the original stack to the air-separable position. The originals are mounted on the original tray 2 so that the trailing edges thereof abut the shutter 41. The shutter 41 is driven by stack transfer motor 80. When the originals are conveyed through the switchback path, the shutter 41 is retracted by solenoid 81 so as to be prevented from impeding conveyance of original. This stack transfer motor 80 is also used for jogging the original returning to the original tray 2 through the closed loop path again toward the separating/feeding means.

The stack thickness detecting mechanism 200 (see FIG. 2 and FIG. 3) is provided for detecting the thickness of the original stack mounted on the original tray 2. The stack thickness detecting mechanism 200 of the present embodiment is arranged to detect the thickness of the stack of originals, based on an angle of rotation of recycle levers 3. The stack thickness detecting mechanism 200 is constructed specifically of a gear system for amplifying an amount of rotation of recycle levers 3, a slit plate for outputting the amount of rotation amplified as the number of pulses generated, and a photosensor or the like. Of course, the recycle levers 3 also constitute parts of the stack thickness detecting mechanism 200. These gear system and other elements are set inside the side regulating plate 4. The stack thickness detecting mechanism 200 outputs the detection result (specifically, a pulse signal in which the number of pulses generated vary depending upon the thickness of stack) to the control device 300 described hereinafter.

The conveying roller 10 is provided for conveying the original separated by the air separating device 426 etc. and is driven by the separating motor 52.

Registration roller 11 is driven by stepping motor 64. The stepping motor is used because the constant speed property relative to the conveying belt 40 is of the significance (for assuring high-accuracy registration). A clock disk 65 is attached to the drive shaft of stepping motor 64. A clock detecting sensor 66 is provided for detecting out-of-step of the stepping motor 64.

Backup roller 14*a* is provided in a turn path section in order to make handling of a thick sheet or the like more advantageous. The backup roller 14*a* also serves as a feeding roller for a sheet inserted through feeding port 13 of manual feeding path. The backup roller 14*a* is driven by turn roller 8 driven by the conveying belt 40. The peripheral velocity of the backup roller 14*a* is arranged so as to be equal to the velocity of the conveying belt 40.

Turn flapper 14 is provided for guiding the original under conveyance so as to prevent the original from being caught by platen edge 105*a*, and the turn flapper 14 is constructed so that the position of the height thereof can be adjusted depending upon the circumstances at that time. For example, when the original is conveyed through the closed loop path to the platen, the turn flapper 14 is located higher than a platen edge section 105*a*. When the original is fed through the manual path feeding port 13, the turn flapper 14 is also located higher than the platen edge section 105*a*. Conversely, when after completion of copy the original is again moved back in the direction E, the turn flapper 14 is retracted so as to be lower than the platen edge section 105*a* in order to scoop the original up from the platen edge section 105*a*. The turn flapper 14 is driven by solenoid 76*a*.

Flapper 14' is provided for guiding an original manually fed, to the manual feeding port 13. The flapper 14' is driven by solenoid 76*b*. Numeral 12 designates a manual feeding roller.

The separating motor 52 is provided for driving the conveying roller 5, retard belt 5', feeding roller 5", adsorption belt 7, and conveying roller 10. When the separating motor 52 is rotated forward, it drives the conveying roller 5, retard belt 5', and feeding roller 5". When the separating motor 52 is rotated backward, it drives the adsorption belt 7 and conveying roller 10. Transmission of driving force between the separating motor 52 and the adsorption belt 7 is effected through clutch 70. Accordingly, the separating belt 7 can be actuated or stopped without stopping the separating motor 52 by turning the clutch 70 on or off. The separating motor shaft of the separating motor 52 is equipped with a clock disk 53 and a clock sensor 54 for speed control.

The stack transfer motor 80 is the stack transfer driving means and is also a drive source for jogging the original returned after handling of sheet through the closed loop, again toward the separating/feeding means. In the present embodiment it is a stepping motor.

Various sensors (empty sensor 30, original set sensor 34, closed loop separation sensor 35, closed loop registration sensor 36, image head sensor 37, and manual feeding set and discharge sensor 38) for monitoring the conveying status of original are provided at respective positions of the closed loop path. The empty sensor 30 is shared with the switchback path. The original set sensor 34 is provided for detecting whether the set original is of a half size (A4, LTR, or B5) or is longer than those, based on presence or absence of the trailing edge of original when the originals are set. The original set sensor 34 also functions as an original stack leading edge detecting sensor. The closed loop separation sensor 35 is a sensor for detecting that the original is separated. The closed loop registration sensor 36 is a sensor for taking the timings of closed loop registration and correction of oblique feed. The image head sensor 37 is a sensor for positioning the original on the platen.

Figure 6:
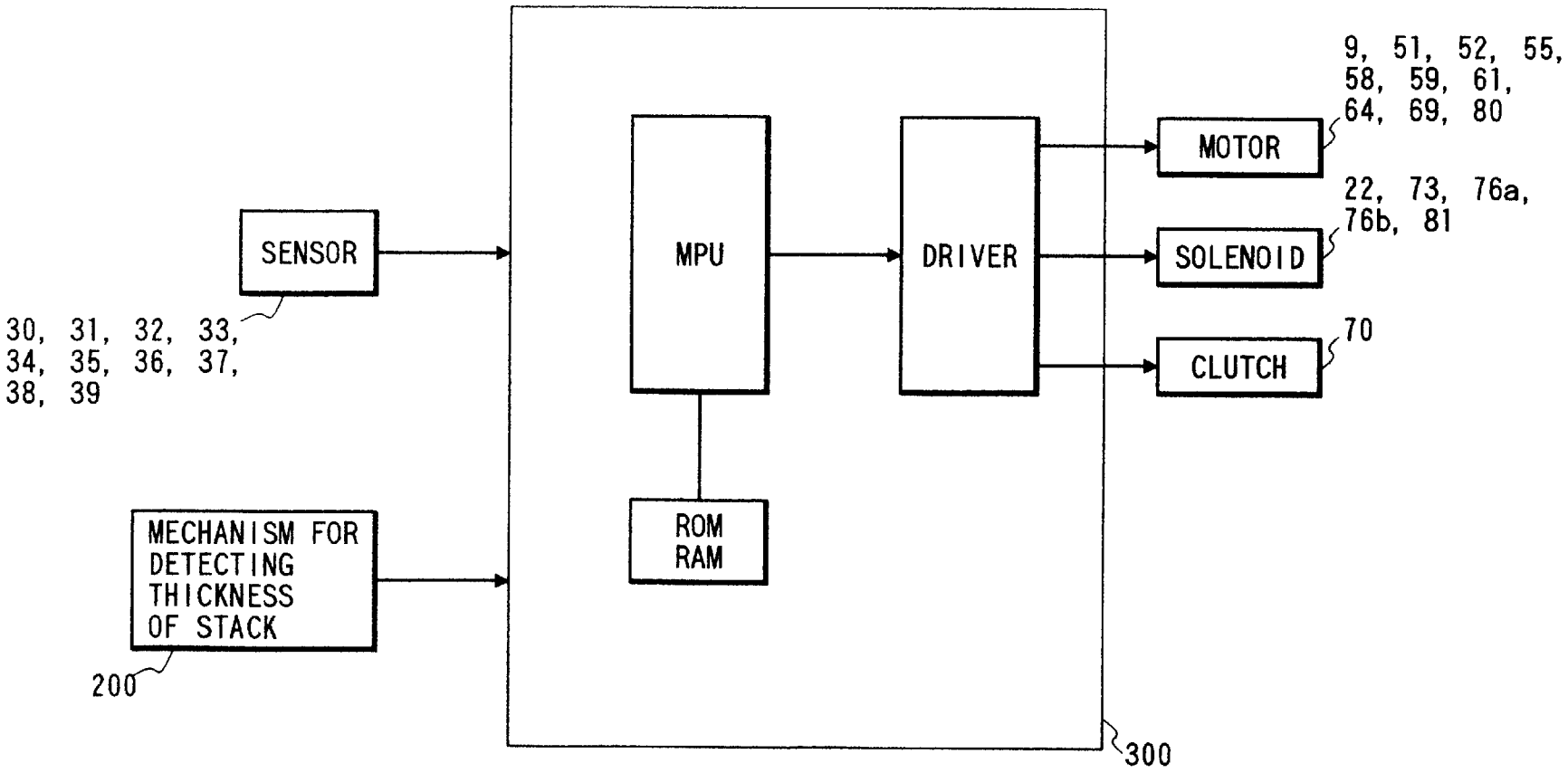
FIG. 6 is a drawing to show the structure for control by a controlling device.

Next, the structure for control in the image forming apparatus, especially in the automatic original feeding apparatus 1 herein, will be described referring to FIG. 6.

The automatic original feeding apparatus 1 is generally controlled by the control device 300. The control device 300 is mainly constructed of the aforementioned microprocessor unit (MPU) incorporating ROM and RAM. As shown in FIG. 6, signals from the various sensors etc. described above are supplied to the input ports of the MPU. Further, the loads described above are connected through a driver to the output ports of the MPU.

The control device 300 executes the programs stored in the ROM and RAM to control the above-stated sections, thereby realizing the various functions. For example, the control device 300 has a function for adjusting the valve travel of air valve 408 according to the thickness of original stack by controlling the stepping motor 9. The data necessary for the various controls (for example, information (LUT) indicating the relation between the number of pulses outputted from the stack thickness detecting mechanism 200 and the amount of rotation of separating air valve 408) is preliminarily stored in (or supplied with necessity to) the ROM and RAM. The functions of the control device 300 will be described in further detail in the description of the operation.

The "friction separating/feeding means" and "first separating means" in the present invention are realized by the retard belt 5', feeding roller 5", separating motor 52, etc. in the present embodiment. The "air separating/feeding means" and "second separating means" are realized by the adsorption belt 7, air separating device 426, and so on. The "selecting means" is realized by the control device 300 etc. The "image reading section" corresponds to the platen 105. The "first conveying means" and "switchback conveying means" are realized by the feeding roller 6, conveying belt 40, conveying/discharging roller 16, and so on. The "second conveying means" and "closed loop conveying means" are realized by the registration roller 11, conveying belt 40, conveying roller 6, and so on.

The "sheet" in the present invention corresponds to the original stated in the present embodiment. The "sheet tray" corresponds to the original tray 2. The "moving means" corresponds to the shutter 41, adsorption belt 7, and the mechanism for actuating these members. The "pushing means" corresponds to the shutter 41, stack transfer motor 80, and so on. The "conveying belt" corresponds to the adsorption belt 7, separating motor 52, and so on. The "separating means" corresponds to the air separating device 426, the blower, and so on. The "separation position" corresponds to the air separation position where the original can be separated by the air separating device 426. The "control means" corresponds to the control device 300. The "thickness detecting means" corresponds to the recycle levers 3 and the stack thickness detecting mechanism 200.

The original conveying operation in the present embodiment will be described.

The original tray 2 is normally located on the upper side. When the stack of originals is set on the original tray 2, the control device 300 detects the original size etc. to determine which conveying path should be used, depending upon the detection result. For example, when the empty sensor 30 is on and the original set sensor 34 is off, the control device 300 determines that the size of originals mounted on the original tray 2 at that time is the half size (A4 or B5 herein) and thus determines use of the closed loop path. In practice, the control device also determines the size of either A4, LTR, or B5 by simultaneously carrying out detection of the empty sensor 30, the original set sensor 34, and the original width (though not illustrated). The operation after this will be described in separate sections of [1] conveyance of original through the switchback path and [2] conveyance of original through the closed loop path.

[1] Conveyance of Original Through the Switchback Path

When the user turns the copy button (not illustrated) on, the recycle levers 3 are placed on the uppermost original.

Separation-conveyance is carried out in order from the lowermost original of the stack of originals P mounted on the original tray 2. The original separated is guided through the path PH1 and is then positioned at the predetermined position on the platen 105 of the image forming apparatus 100. Then the exposure operation by the optical system is carried out. After completion of the exposure operation, the original is returned in the direction C (through the discharge path PH2) and again moved back onto the original tray 2.

After the all originals have been conveyed, the recycle levers 3 move down to be lower than the mounting surface of the original tray 2. This causes the control device to recognize completion of circulation of the originals in one cycle.

Figure 7:
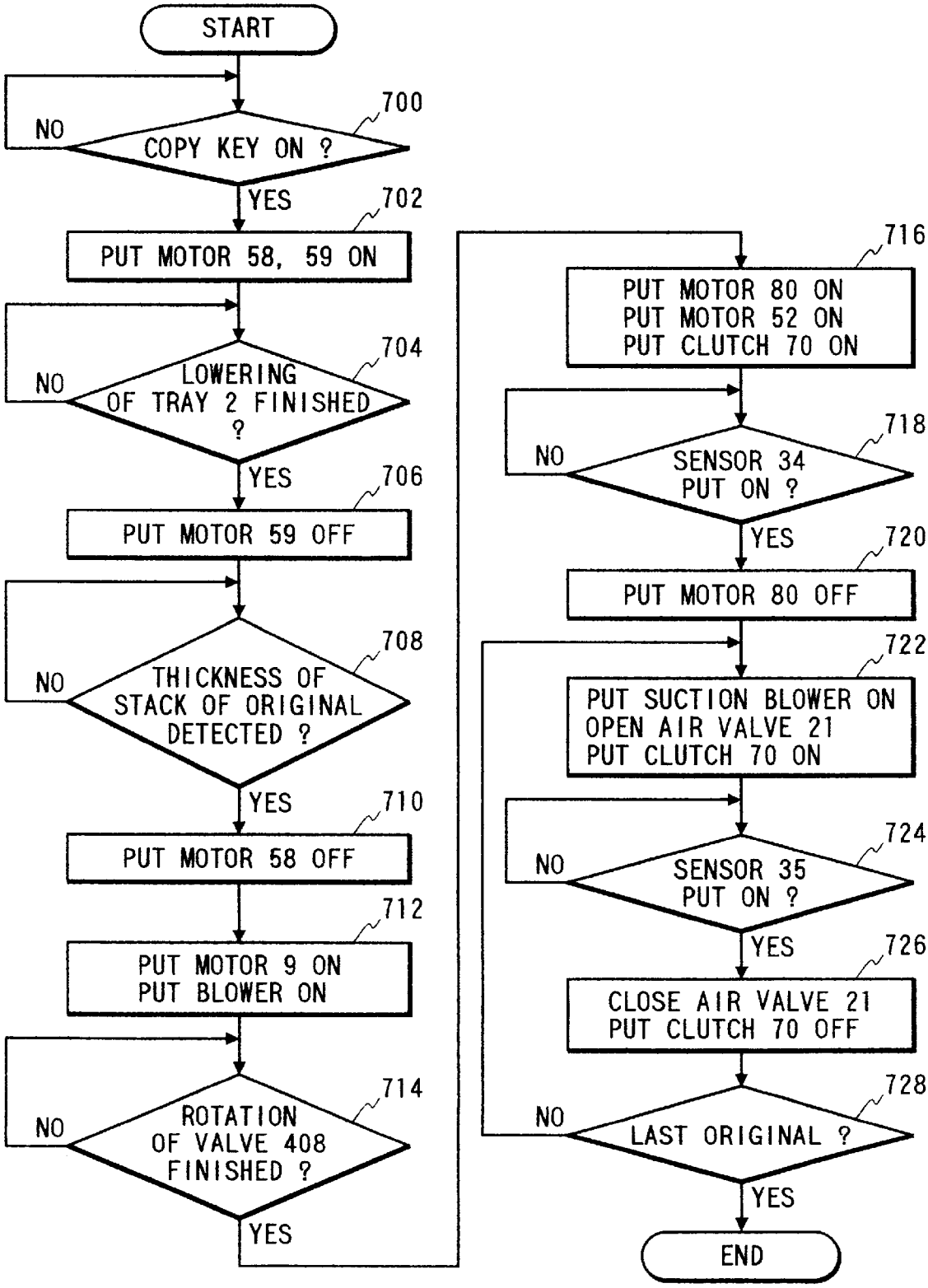
FIG. 7 is a flowchart to show the control operation of original conveyance.
Figure 8:
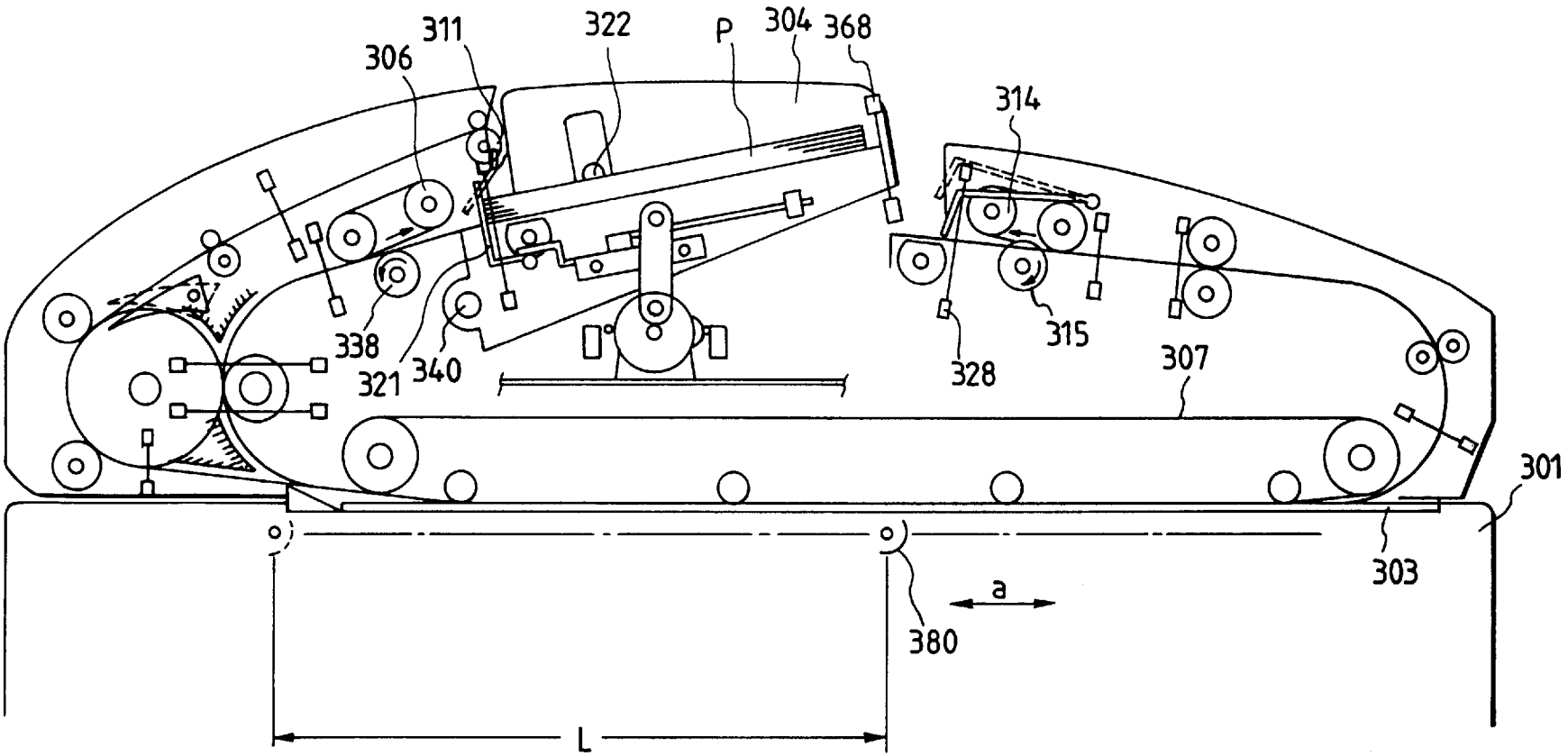
FIG. 8 PRIOR ART
FIG. 8 is a drawing to show the conventional apparatus.

[2] Conveyance of Original Through the Closed Loop Path (see FIG. 7)

The control device 300 is in a standby state to wait for actuation of the copy button (not illustrated) (step 700). When the user turns the copy button (not illustrated) on, the control device 300 actuates the recycle motor 58 to start descent of the recycle levers 3 toward the original. The control device also actuates the tray up/down motor 59 to start descent of the original tray 2 (step 702). Then the control device waits before the original tray 2 is moved down to the position of air-separable height (step 704). After the original tray 2 is lowered down to the predetermined position, the up/down motor 59 is stopped (step 706).

During this period, when the recycle levers 3 land on the original stack, the stack thickness detecting mechanism 200 outputs a pulse signal according to the position (angle) of the recycle levers 3, i.e., according to the thickness of the original stack mounted on the original tray 2 at this time, to the control device 300. The control device 300 checks whether the thickness of the original stack was detected (step 708), and the control device 300 stops the recycle motor 58 when it is confirmed (step 710).

Then the control device 300 determines the valve travel of the separating air valve 408, based on the number of pulses at this time. Then the control device controls the stepping motor 9 so as to achieve the determined valve travel, thus starting adjustment of valve travel of the separating air valve 408. In tandem therewith, the control device 300 actuates the blower to start blowing of air by the air separating device 426 (step 712). Then the control device 300 waits before the separating air valve 408 comes to a set angle (step 714). When it is confirmed that the separating air valve 408 is set at the set angle (it should be noted that the setting does not always have to be confirmed, but it may be assumed that the valve becomes set at the set angle after a lapse of a predetermined time), the control device 300 actuates the stack transfer motor 80 to make the shutter 41 push the original stack, thus starting moving of the stack to the air separation position. At the same time as it, the separating motor 52 and clutch 70 are actuated to start rotation of the adsorption belt 7. At the same time, the rotation of the conveying roller 10 is also started (step 716). At this time the control device 300 controls the stack transfer motor 80 and separating motor 52 so that the moving speed of shutter 41 becomes equal to the rotating speed of the adsorption belt 7. Namely, the moving speed of the original stack by the shutter 41 is synchronized with the rotation of the adsorption belt 7. Accordingly, the stack will not be disturbed with an increase in the moving speed of the original stack.

During transfer of the original stack the control device 300 monitors whether the leading edges (the right edges in FIG. 1) of the originals reach the air separation position, based on the detection result of the original set sensor 34 (step 718). When the leading edges reach the air separation position, the stack transfer motor 80 is turned off to stop the movement of the original stack (step 720). In practice, the arrival at the air separation position is assumed when the original set sensor 34 detects the leading edge of moving original (or after a lapse of a predetermined time from the time of the detection).

After this, the control device 300 actuates the suction blower to start suctioning the original to the adsorption belt 7 and the control device 300 also turns the clutch 70 on to start the rotation of the adsorption belt 7 (step 722). In this case, the separating air valve 408 has already started blowing air in a quantity suitable for the thickness of the original stack at that time, and the separation of original can be done immediately.

After the start of the separation operation, the control device 300 monitors whether the original is separated, based on the detection result of the closed loop original separation sensor 35 (step 724). Then, confirming that the original is separated and fed, the control device turns the clutch 70 off to temporarily stop the rotation of the adsorption belt 7. It also closes the air valve 21 (step 726).

After this, the control device 300 checks whether the original thus separated at that time is the last original (step 728). If the original is not the last original, the same process will be repeated, returning to the step 722. On the other hand, if the original is the last original, the operation will be terminated.

Figure 2:
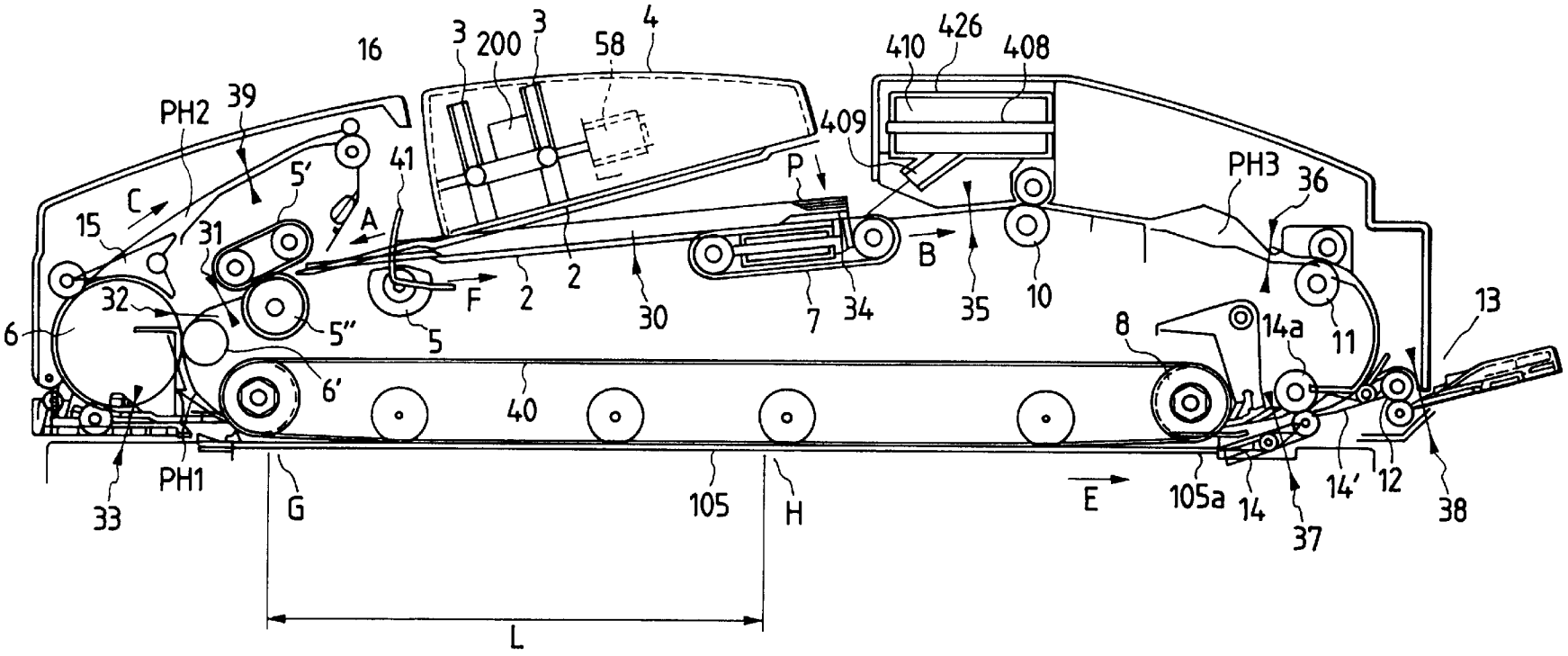
FIG. 2 is a drawing to show the structure of an automatic original feeding apparatus.
Figure 3:
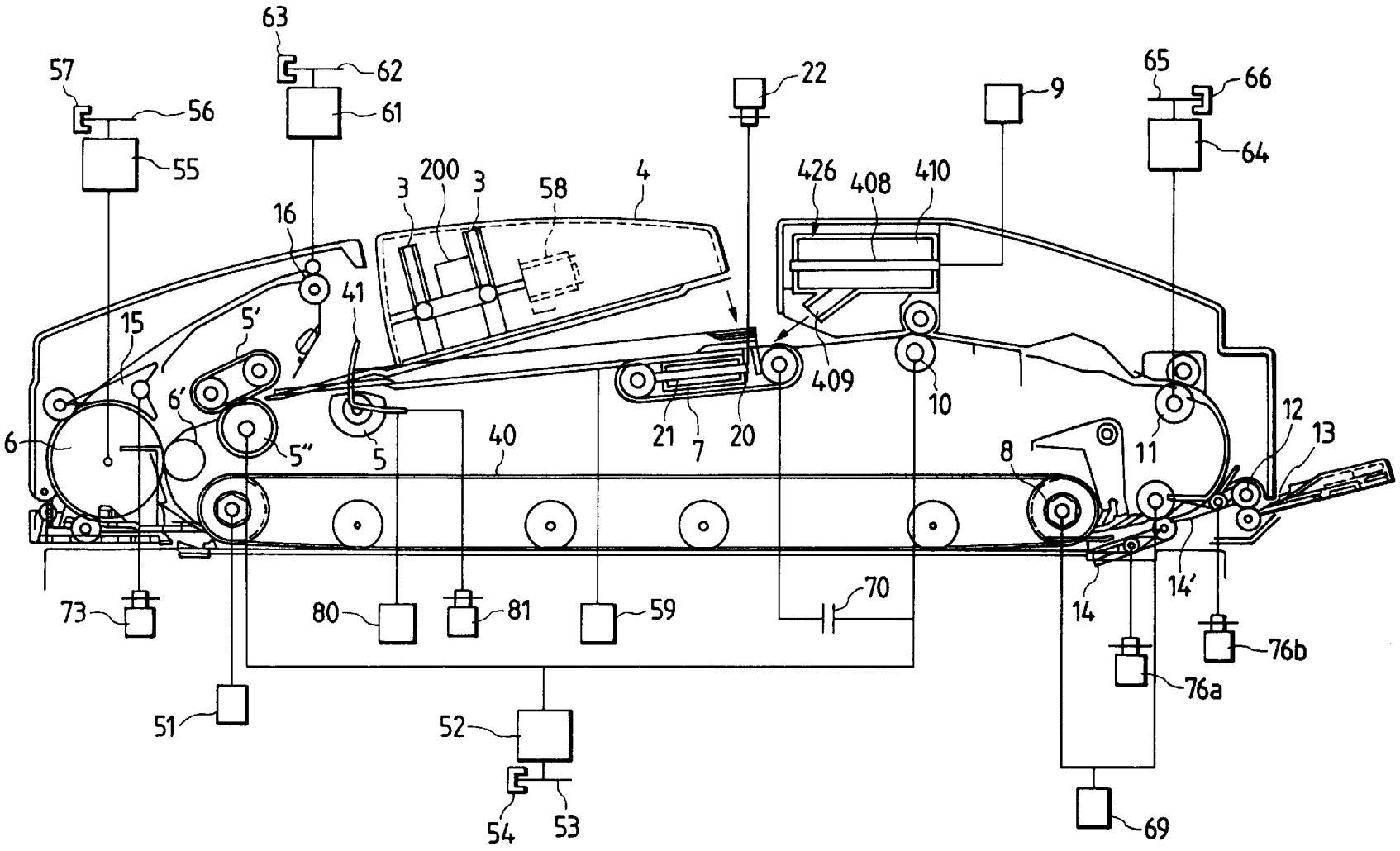
FIG. 3 is a drawing to show the structure for driving of the automatic original feeding apparatus.

The original thus separated in this way is guided through the path PH3 to be positioned at the predetermined position on the platen 105 of the image forming apparatus 100 (see FIG. 2). Then, after completion of the exposure operation, the original is returned in the direction C (through the discharge path PH2) onto the original tray 2.

The embodiment described above permits the original stack to be conveyed quickly to the air-separable position without causing stack deviation of the original stack. This can decrease the fast copy time (Fcot). Further, since the air quantity of the separating air is adjusted to the optimum value according to the thickness of the original stack, prior to the start of air separation-feeding, an original can be separated by air immediately after the original stack reaches the air-feedable point. This can also decrease the fast copy time (Fcot).

In the embodiment described above, the conveying belt 40 and registration roller 11 were driven by the stepping motor. Instead thereof, however, the constant speed control in the transfer section may be realized by the PLL control of DC motor. In another arrangement, the conveying belt and registration roller may be simultaneously actuated by a common drive source through actuation/deactuation of a clutch by use of one drive source and clutch means or the like.

In the present embodiment the thickness of the original stack was detected utilizing the recycle levers. It is, however, needless to mention that a mechanism for detecting the thickness of the original stack can be provided separately and independently from the recycle levers.

In the present embodiment, in transferring the original stack to the air-feedable position (air separating position) by the shutter 41, the blowing of separating air was started before the original stack reached the air separation position. However, the apparatus may be arranged to start at least preparation for blowing (for example, setting of the air quantity according to the thickness of the original stack), whereby the fast copy time (Fcot) can be decreased, though the effect thereof is less (than in the above embodiment). The apparatus may also be modified in such a manner that adhesion to the adsorption belt 7 is also carried out upon rotation of the adsorption belt 7 in synchronism with the movement of the original stack.

As described above, the sheet conveying apparatus of the present invention employs the separating and feeding method by the retard system in the switchback path and the air separating and feeding method in the closed loop path.

Since the separation by air feeding is carried out during the flow reading or the like through the closed loop path, normally most frequently used, such as processing of many originals in terms of the productivity, the apparatus of the invention is free of the problems of the original damage and durability due to the edge soiling and separation at the leading edge of original. Further, in the case of the originals having the binding holes, the originals will be set on the original tray so that the hole side is naturally directed to the left when seen from the user. Therefore, the hole side of the originals is located in the upstream end in the feeding direction upon air feeding through the closed loop path, so that the apparatus is free of the problem of floating failure of original due to leakage of the separating air through the holes upon the air feeding as described previously.

In the case of feeding of the originals of different sizes mixed, the originals can be fed by the retard method through the switchback path, so that the apparatus can handle a wider range of originals than the apparatus employing only the air feeding method, thus enhancing the operability.

The features achieved by the provision of two separating/feeding means of the different methods are as follows.

The flow reading of small size sheets (A4, B5, etc.), which are used most frequently, is set as a standard mode and the air separating/feeding section is used preferentially.

In analog copiers, it is essential to move the original from right to left on the platen upon the flow reading, and the air feeding section is thus located on the right side.

The friction separating section is used for large-size sheets and for sheets of different sizes mixed. The conventional apparatus needed a mechanism for sliding the rear edge regulating plate, for feeding the originals of the small size and large size by use of one RDF, and the size of the RDF itself was large. The RDF of the present invention employed the folding tray and friction separating section for the large sizes, thus compactifying the body of RDF.

The friction separating/feeding section is used for perforated originals. The perforated originals, which were hard to deal with heretofore by air separation, can be separated more certainly by use of the friction separating section.

According to the feature of air separation and feeding, when the sheets are mounted on the sheet tray, the thickness detecting means detects the thickness of the sheet stack. The moving means moves the sheet stack mounted on the sheet tray to the predetermined separation position. When the moving means is composed of the conveying belt and pushing means, the conveying belt rotates in synchronism with the movement of the sheet stack by the pushing means. This permits the stack to retain its shape even with increase in the speed of movement of the sheet stack.

The control means makes the separating means start the blowing of air prior to the arrival of the sheet stack at the separation position. In this case, the blowing amount of air is set according to the detection result of the thickness detecting means. Since the separating means has already started blowing of air at the time of arrival of sheets at the separation position, separation can be done immediately.

What is claimed is:

1. A sheet feeding apparatus comprising:

a friction separating/feeding means for separating and feeding a sheet by making use of frictional force;

an air separating/feeding means for separating and feeding a sheet by making use of air; and a selecting means for selecting either one of said friction separating/feeding means and said air separating/ feeding means and for making the selected means separate and feed the sheet.

2. A sheet reading apparatus comprising:

the sheet feeding apparatus as set forth in claim 1; and a reading means for reading a sheet having been fed thereto by said sheet feeding apparatus.

3. A sheet feeding apparatus according to claim 1, further comprising:

a sheet tray on which a stack of sheets are to be rested;

moving means for moving the stack of sheets rested on said sheet tray to a predetermined separation position on said sheet tray, wherein said air separating/feeding means separates a lowermost sheet from other sheets by blowing air to a lower portion of a leading edge of the stack of sheets having been moved to said separation position; and control means for controlling said moving means and said separating/feeding means, wherein said control means controls said air separating/feeding means to start blowing air prior to arrival of the stack of sheets at said separation position.

4. A sheet feeding apparatus according to claim 3, further comprising thickness detecting means for detecting a thickness of the stack of sheets rested on said tray, wherein said control means changes an amount of air blown from said air separating/feeding means according to a detection result of said thickness detecting means.

5. A sheet feeding apparatus according to claims 3 or 4, wherein said moving means comprises pushing means for pushing a trailing edge of the stack of sheets to move the stack of sheets, and conveying belt set on a tray surface of said tray, wherein said conveying belt rotates in synchronism with a movement of the stack of sheets by said pushing means.

6. An image reading apparatus comprising:

image reading means comprising a sheet table, said image reading means reading an image of a sheet rested on said sheet table; and the sheet feeding apparatus as set forth in claim 5, for sucessively conveying sheets to said sheet table.

7. A sheet feeding apparatus according to claim 1, further comprising:

a sheet tray on which at least one sheet is to be rested;

pushing means for pushing a trailing edge of the sheet rested on the sheet tray to move the sheet to a predetermined separation position on said sheet tray;

a conveying belt set in a tray surface of said sheet tray; and control means for controlling said pushing means and said conveying belt, wherein said control means controls said conveying belt to rotate in synchronism with a movement of the sheet by said pushing means.

8. An image reading apparatus comprising:

image reading means comprising a sheet table, said image reading means reading an image of a sheet rested on said sheet table; and the sheet feeding apparatus as set forth in claims 3, 4, or 7, for sucessively conveying sheets to said sheet table.

9. A sheet feeding apparatus according to claim 1, further comprising:

a tray on which at least one sheet is to be rested, wherein said friction separating/feeding means separates a sheet rested on said tray, and includes feeding means and retard means, and said air separating/feeding means separates a sheet rested on said tray, and includes an air knife and vacuum suction conveying means.

10. A sheet feeding apparatus according to claim 9, further comprising:

switchback conveying means including a switchback conveying path, said switchback conveying means conveying the sheet separated by said friction separating/feeding means through said switchback conveying path from one end of an image reading section into the image reading section and thereafter switching the sheet back to convey the sheet through said switchback conveying path out of the image reading section; and closed loop conveying means including a closed loop conveying path forming a closed loop, said closed loop conveying means conveying the sheet separated by said air separating/feeding means through said closed loop conveying path, thereby conveying the sheet from the other end of the image reading section into the image reading section, said closed loop conveying means conveying the sheet out of the image reading section from a side opposite to a side where the sheet is conveyed thereinto.

11. A sheet feeding apparatus according to claim 10, wherein said switchback conveying means temporarily stops the sheet on the image reading section whie the image reading apparatus is reading an image, and wherein said closed loop conveying means continues conveyance of the sheet conveyed into the image reading section even while the image reading apparatus is reading the image.

12. A sheet feeding apparatus according to claim 10, wherein said friction separating/feeding means is provided on one side of said tray, wherein said air separating/feeding means is provided on another side of said tray different from the one side of said tray where said friction separating/feeding means is provided, and wherein at least one of said switchback conveying means and said cosed loop conveying means returns a conveyed sheet to said tray.

13. A sheet feeding apparatus according to claim 12, further comprising:

moving means for moving a stack of sheets rested on said tray to a predetermined separation position on said tray; and control means for controlling said moving means and said spearating/feeding means;

wherein said air separating/feeding means separates a lowermost sheet from other sheets by blowing air to a lower portion of a leading edge of the stack of sheets having been moved to said separation position, wherein said control means controls said air separating/feeding means to start blowing air prior to arrival of the stack of sheets at said separation position.

14. A sheet feeding apparatus according to claim 13, further comprising thickness detecting means for detecting a thickness of the stack of sheets rested on said tray, wherein said control means changes an amount of air blown from said air separating/feeding means, according to a detection result of said thickness detecting means.

15. A sheet feeding apparatus according to claims 13 or 14, wherein said moving means comprises pushing means for pushing a trailing edge of the stack of sheets to move the stack of sheets, and a conveying belt set on a tray surface of said tray, wherein said conveying belt rotates in sychronism with a movement of the stack of sheets by said pushing means.

16. A sheet feeding apparatus applied to an image reading apparatus for reading an image of a sheet existing in an image reading section, said sheet feeding apparatus comprising:

a friction separating/feeding means for separating and feeding a sheet by making use of frictional force;

a first conveying means for guiding the sheet separated and fed by said friction separating/feeding means to said image reading section;

an air separating/feeding means for separating and feeding a sheet by making use of air;

a second conveying means for guiding the sheet separated and fed by said air separating/feeding means to said image reading section; and a selecting means for selecting one of said friction separating/feeding means and said air separating/feeding means and for making the selected means separate and feed the sheet.

17. A sheet reading apparatus comprising:

the sheet feeding apparatus as set forth in claim 1 or 16; and a reading means for reading a sheet having been fed thereto by said sheet feeding apparatus.

18. An image forming apparatus comprising:

the sheet feeding apparatus as set forth in claim 1 or 16;

a reading means for reading an image of a sheet having been fed thereto by said sheet feeding apparatus; and an image forming means for forming the image of the sheet having been read by said reading means, on a recording medium of a sheet shape.

* * * * *

UNITED STATES PATENT AND TRADEMARK OFFICE

CERTIFICATE OF CORRECTION

PATENT NO. : 6,076,819

DATED : June 20, 2000

INVENTOR(S): MICHIRO KOIKE, ET AL.

It is certified that error appears in the above-identified patent and that said Letters Patent is hereby corrected as shown below:

COLUMN 2

Line 48, "the" (first occurrence) should be deleted.

Line 49, "again fed" should read --fed again--; and "again" should read --copied--.

Line 50, "copied." should read --again.--.

Line 56, "originals of a setting number" should read --originals of a set number of--.

Line 64, "of" should read --of the--.

COLUMN 5

Line 29, "to" should be deleted and "means" (second occurrence) should read --means to--.

COLUMN 7

Line 43, "the" should be deleted.

UNITED STATES PATENT AND TRADEMARK OFFICE

CERTIFICATE OF CORRECTION

PATENT NO. : 6,076,819

DATED : June 20, 2000

INVENTOR(S): MICHIRO KOIKE, ET AL.

It is certified that error appears in the above-identified patent and that said Letters Patent is hereby corrected as shown below:

COLUMN 10

Line 11, "when" should be deleted.

COLUMN 16

Line 30, "whie" should read --while--.

Line 52, "means;" should read --means,--.

Line 57, "position," should read --position, and--.

Signed and Sealed this

Eighth Day of May, 2001

*Attest:*

Nicholas P. Godici

NICHOLAS P. GODICI

*Attesting Officer*

*Acting Director of the United States Patent and Trademark Office*